United States Patent [19]

Meier

[11] 4,316,422

[45] Feb. 23, 1982

[54] COMBINED SEWING MACHINE HOUSING AND CLAMPING JIG

[75] Inventor: Willi Meier, Karlsruhe-Durlach, Fed. Rep. of Germany

[73] Assignee: Dorina Nahmaschinen GmbH, Fed. Rep. of Germany

[21] Appl. No.: 73,636

[22] Filed: Sep. 10, 1979

[30] Foreign Application Priority Data

Sep. 8, 1978 [DE] Fed. Rep. of Germany ..... 2839090

[51] Int. Cl.[3] ..... C05B 73/00

[52] U.S. Cl. ..... 112/258; D15/76; 269/296

[58] Field of Search ..... 112/259, 258, 257, 217.1; D15/76; 269/303, 296, 74

[56] References Cited

U.S. PATENT DOCUMENTS

| | | | |
|---|---|---|---|
| D. 52,854 | 1/1919 | Onderdonk | 112/258 X |
| D. 140,382 | 2/1945 | Foster | D15/76 |
| 1,349,632 | 8/1920 | Staley | 269/303 X |
| 2,724,355 | 11/1955 | Heimann | 112/258 |
| 4,044,701 | 8/1977 | Giesselmann et al. | 112/259 |
| 4,193,361 | 3/1980 | Johnson | 112/259 |

FOREIGN PATENT DOCUMENTS

| | | | |
|---|---|---|---|
| 1083111 | 6/1960 | Fed. Rep. of Germany | 112/258 |
| 2312587 | 5/1973 | France | 112/259 |

*Primary Examiner*—Werner H. Schroeder
*Assistant Examiner*—Andrew M. Falik
*Attorney, Agent, or Firm*—McGlew and Tuttle

[57] ABSTRACT

A combined sewing machine housing and a clamping jig therefor to position the housing for machining purposes comprises a housing bed arm having a column connected to one end and extending upwardly therefrom and supporting one end of an upper arm. The clamping jig includes a post having stop guards thereon for aligning the upper arm and bed arms and column so that they may be positioned on the top of the jig. The sewing machine housing also has a plurality of bearing surfaces defined thereon which may be aligned with or engaged over a corresponding number of clamping elements in the form of rotatable dogs. When the housing is in position on the clamping jig it will be aligned so that one clamping dog enters through an opening of the sewing machine housing and may be rotated into a position to clamp against a bearing surface and the other clamping dogs may be rotated to engage over a bearing surface which is positioned alongside of it.

7 Claims, 3 Drawing Figures

COMBINED SEWING MACHINE HOUSING AND CLAMPING JIG

BACKGROUND OF THE INVENTION

FIELD OF THE INVENTION

This invention relates in general to the construction of sewing machines and in particular to a combination sewing machine and jig therefor for holding the sewing machine for machining purposes.

The invention is concerned particularly with the construction of sewing machine housings such that they may be held in clamping jigs by clamping elements which do not mar or destroy the finish thereof.

In the prior art, such housings are machined in unfinished state, prior to applying the final lacquer coat. To this end, the housing is held fast in a clamping fixture, with the clamping elements applied preferably to locations at opposite outsides of the housing. At these locations, however, the clamping elements leave impressions which, prior to putting on the final lacquer coat, must be filled out and then ground smooth.

To minimize the labor costs for removing the lacquer residues, from the machined surfaces, threads, and bores after the final lacquer coating, these machined areas are masked prior to the finishing as far as possible. This requires a plurality of various types of masking elements which must then be cleaned and replaced after relatively short time periods and with considerable expenses.

Certain areas of the housing, such as the guide for the oscillating needle bar, the bore for the presser foot bar, and screw-on surfaces for the bed plate, cannot be satisfactorily covered to avoid lacquer penetration, and must be cleaned manually after the final coating.

During the lacquer drying operation, the finished housings are exposed to relatively high temperatures. This produces stresses in the material which not infrequently lead to such warpage of the housings that the dimensions obtained with the machining are changed. Particularly frequent is a misaligning of the bearing bores initially aligned in a common straight line. To mitigate this result affecting the quality, the housings have been subjected, prior to the machining, to a heat treatment to remove the stresses in the material. This, however did not lead to any substantial improvement.

SUMMARY OF THE INVENTION

The invention is directed to a maximum possible or even complete elimination of imperfections or reworking operations caused by the final lacquer application to the housing and the following heat treatment.

In accordance with the invention there is provided a sewing machine housing which includes a bed arm and an upper arm interconnected by a column at one end and which are provided with clamping surfaces at diverse locations for example at the corners of the frame structure formed by these elements and preferably in a location in which they are covered by an exterior cover after machining. The sewing machine is constructed so that it will fit on a jig having an upright post with stop guards oriented to contact and position the column and the upper and lower arms. With the sewing machine thus positioned the various clamping surfaces are exposed alongside clamping dogs of the jig which are rotated to overlie the clamping surfaces to hold the sewing machine housing in position.

The invention provision makes it possible for the first time to machine the housing to a state ready for assembly after the final lacquer application and the subsequent heat treatment, without any reworking, and thus also to avoid the negative consequences of a warpage of the material caused by the exposure to heat during the lacquer drying operation.

It is particularly advantageous to utilize the bearing surfaces at the same time as datum surfaces for the machining operation.

To minimize the thickness of the housing walls, for reasons of saving weight, but, on the other hand, to ensure a satisfactory material thickness needed for a secure clamping of the housing, the bearing and clamping surfaces are provided on extensions or reinforcing ribs of the housing.

With a housing which has been formed in a multipart casting mold, square dimensional starting conditions are obtained by providing all the bearing surfaces of the housing in a zone which is formed by a single part of the casting mold.

In accordance with the invention there is provided a combined housing, particularly a sewing machine housing, and a clamping jig therefor to position the housing for machining purposes wherein the housing includes a bed arm and an upper arm connected at their one ends to a column which extends therebetween and which carry reinforcing elements or similar structures on the housing which define clamping surfaces or bearing surfaces which are accessible before the housing is covered. The sewing machine housing is engaged in a jig which has an upright post defining stop guards which bear against the upper and lower arms and the columns to position the housing so that the bearing surfaces are disposed alongside clamping dogs which are rotated into engagement with the surfaces to hold the housing in position.

A further object of the invention is to provide a sewing machine housing and to also provide a clamping jig which are simple in design, rugged in construction and economical to manufacture.

The various features of novelty which characterize the invention are pointed out with particularity in the claims annexed to and forming a part of this disclosure. For a better understanding of this invention, its operating advantages and specific objects attained by its uses, reference is made to the accompanying drawings and descriptive matter in which preferred embodiment of the invention is illustrated.

DESCRIPTION OF THE PREFERRED EMBODIMENT

Figure 1:
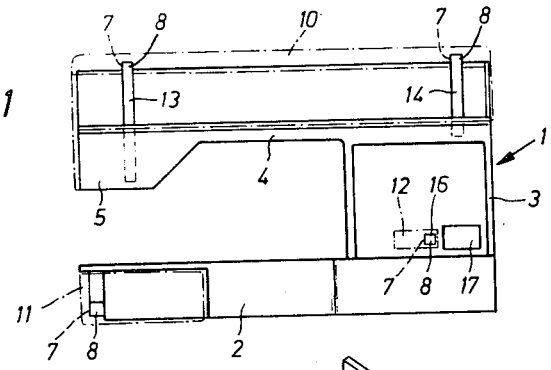
FIG. 1 is a side elevational view of a sewing machine housing constructed in accordance with the invention.

Referring to the drawings in particular the invention embodied therein comprises an improved sewing machine housing frame generally designated 1 which in accordance with the invention is provided with a plurality of bearing ements or members 7 strategically located around the periphery of the frame and which define clamping surfaces 8 for facilitating the clamping of the sewing machine housing 1 in a clamping fixture or jig 6.

The sewing machine housing 1 made in one piece comprises a bed arm 2, a column 3, and an upper arm 4 with a head portion 5.

To be able to fix the housing 1 in a finish-coated state in a clamping fixture 6, in order to perform machining operations, bearing surfaces 7 and, opposite thereto, on the backside, clamping surfaces 8 serving as contact surfaces for movable clamping dogs 9 of clamping fixture 6, are provided at such locations of housing 1 that in the completely assembled sewing machine, they are covered by component parts of the sewing machine, such as a cover 10 of the upper arm, a lid 11 closing the bed arm and the information plate 12.

Bearing surfaces 7 and clamping surfaces 8 are provided on extensions of reinforcing ribs 13, 14 of housing 1 projecting upwardly beyond the top edge of upper arm 4, and at the lower end of a web 15 for the looper shaft bearing, and on a reinforcing rib 16 extending adjacent an opening 17 of housing 1 intended for the electrical plug connection. The extensions of reinforcing ribs 13, 14 projecting beyond the top edge of housing 1 also serve as positioning elements for upper arm cover 10.

For each of bearing surfaces 7 of housing 1, the clamping fixture 6 is provided with a fixed, hemispherical boss 18, and each clamping dog 9 carries on its face turned to the respective clamping surface 8 a hemispherical boss 19. Each clamping dog 9 is mounted for rotary motion and longitudinal displacement in a bearing block 20 of clamping fixture 6, and, preferably, is operated hydraulically.

In the shown embodiment, stop guards 21 to 24, with bevelled tops and made of a plastic to avoid damaging of the lacquer coat, are provided as inserts insuring a correct positioning of housing 1 in clamping fixture 6. Stop guard 21 is secured to a support 25 of clamping fixture 6, while stop guards 22–24 are supported on a post 26 of clamping fixture 6. Housing 1 may be positioned in clamping fixture 6 also by other means, of course.

Figure 2:
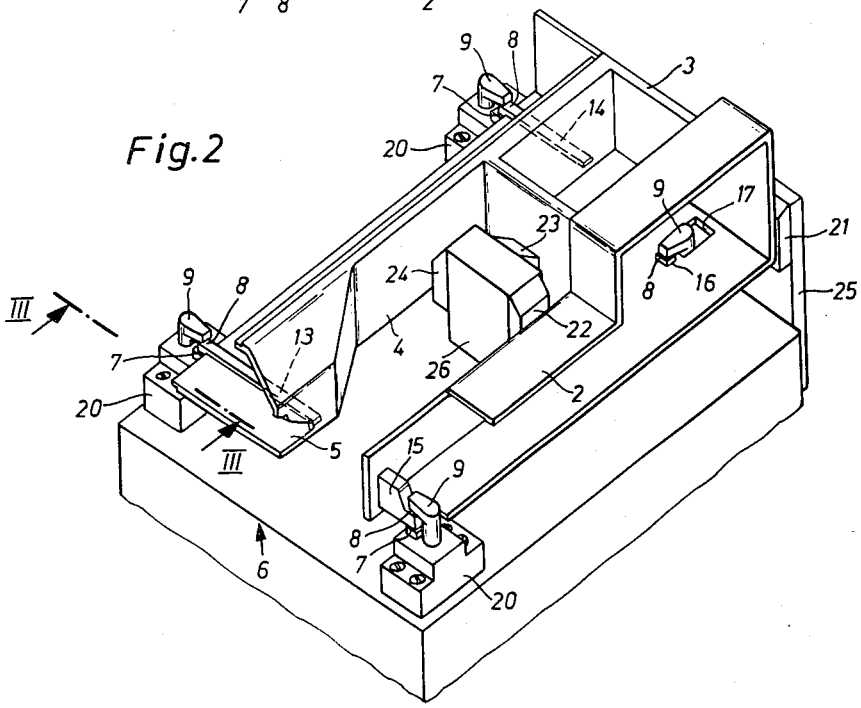
FIG. 2 is an enlarged perspective view of the housing arranged in a clamped position in a jig.
Figure 3:
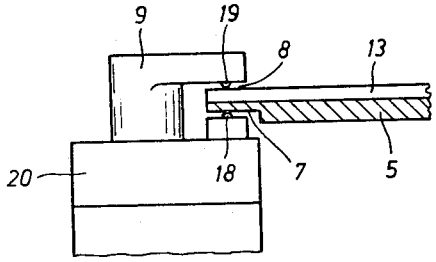
FIG. 3 is a further enlarged sectional view taken along the lines III—III of FIG. 2.

As shown in FIG. 2, three of the clamping guards 9 are provided outside the contour of housing 1. The fourth clamping dog 9, however, extends through opening 17 into the interior of housing 1. To place housing 1 in clamping fixture 6 or to remove it, clamping dog 9 provided in the area of opening 17 is lifted from its clamping position and turned through 180°, to align its head with opening 17.

As to the other three clamping dogs 9, it suffices to lift them and turn through about 90°, to clear the way for placing or removing housing 1.

In the clamping position of dogs 9 shown in FIG. 2, the machining tools can be brought into operation from any side of housing 1, except for the side facing the top surface of clamping fixture 6, so that the housing can be machined to a state completely ready for assembly in a single clamping position.

By a well chosen arrangement of bearing and clamping surfaces 7 and 8 at locations which, with the sewing machine completely assembled, will be covered by other component parts, the points of impression of bosses 18 and 19 will be concealed. That is why machining operations can be performed with the surfaces of the housing already finished.

If housing 1 is formed in a multi-part casting mold and with the bearing and clamping surfaces 7, 8 at locations as shown, all the bearing surfaces 7 of housing 1, which will serve as positioning datum planes for the areas to be machined, are provided in a zone which is formed in a single part of the casting mold.

While a specific embodiment of the invention has been shown and described in detail to illustrate the application of the principles of the invention, it will be understood that the invention may be embodied otherwise without departing from such principles.

What is claimed is:

1. A combined housing particularly a sewing machine housing and a clamping jig therefor to position the housing for machining purposes, comprising a housing having a bed arm, a column with a bottom end connected to one end of said bed arm and extending upwardly therefrom and having an opposite top end, and an upper arm having an inner end connected to the top end of said column with an opposite outer end having a head portion said bed arm and upper arm having respective bottom and top ends opening outwardly, said housing including a plurality of bearing surfaces defined on the interior thereof located in exteriorly accessible locations including said bed arm and upper arm openings, and a clamping jig having an open top receiving surface onto which said housing is placed and having a movable clamping member disposed alongside each of said bearing surfaces and being movable to engage over said bearing surfaces and clamp said housing to said jig.

2. A combined housing according to claim 1, including cover means for said housing covering all of the portions of said housing having said bearing surfaces.

3. A combined housing according to claim 1, wherein said bearing surfaces are located so as to form datum planes for the machining operation.

4. A combined housing according to claim 1, wherein said housing includes reinforcing ribs defining said bearing surfaces.

5. A combined housing according to claim 1, wherein said housing comprises a single molded piece including said bed arm, said column and said upper arm.

6. A jig for use with a sewing machine housing wherein said housing comprises a single part having a column and spaced apart lower and upper arm portions connected to respective top and bottom ends of the column arranged at an enhd thereof, said jig comprising a clamping fixture support having a top face with a post thereon, said post having a stop guard bearing against said upper and lower arms and said column and positioning the housing in respect to said jig, and a plurality of clamping dogs arranged on said jig including a rotatable clamping dog member pivotal thereon adapted to be pivotable into a position to overlie a portion of said housing and clamp it to said jig.

7. A sewing machine housing for a sewing machine adapted to be positioned on a jig and engaged by a plurality of clamping dogs and fixed bosses comprising:

a single casting made with a plurality of mold parts including a base arm portion, a column arm portion, and an upper arm portion;

said base arm portion and said upper arm portion having respective bottom and top ends opening outwardly wherein said opening for said bottom end portion is located such that it faces a support surface for the sewing machine when the latter is in an upright operational position;

means defining bearing surfaces (7) on each of the outwardly opening portions of said base arm portion and said upper arm portion located at widely spaced locations thereon;

component cover parts for covering each of said bearing surfaces;

a rib portion adjacent each of said bearing surfaces and on an opposite side of said respective upper arm and base arm portions from said bearing surfaces forming clamping surfaces (8);

each bearing surface with adjacent clamping surface being engageable between a clamping dog and fixed boss;

said base arm portion and said upper arm portion each having a clamping dog access for each clamping dog;

said housing includes an opening adjacent one of said bearing surfaces in said base arm portion defining one clamping dog access; wherein said opening comprises a hole in said base arm portion, the edges of which form a continuous boundary which is defined by solid portions of said base arm portion.

* * * * *